US007926924B2

(12) United States Patent
Umeda

(10) Patent No.: US 7,926,924 B2
(45) Date of Patent: Apr. 19, 2011

(54) INKJET PRINTER

(75) Inventor: Takaichiro Umeda, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 803 days.

(21) Appl. No.: 11/904,231

(22) Filed: Sep. 26, 2007

(65) Prior Publication Data

US 2008/0079788 A1 Apr. 3, 2008

(30) Foreign Application Priority Data

Sep. 29, 2006 (JP) ..... 2006-267574

(51) Int. Cl.
*B41J 2/175* (2006.01)

(52) U.S. Cl. ..... 347/85; 347/84; 347/86

(58) Field of Classification Search ..... 347/84–86
See application file for complete search history.

(56) References Cited

U.S. PATENT DOCUMENTS

| | | | | |
|---|---|---|---|---|
| 6,168,268 | B1 * | 1/2001 | Sugiyama | 347/89 |
| 6,199,976 | B1 * | 3/2001 | Sasada | 347/85 |
| 6,276,787 | B1 | 8/2001 | Sakanobe et al. | |
| 6,281,916 | B1 * | 8/2001 | VanSteenkiste | 347/85 |
| 6,536,886 | B1 * | 3/2003 | Mott | 347/85 |
| 6,582,067 | B2 * | 6/2003 | Matsuzaki et al. | 347/85 |
| 6,755,514 | B2 | 6/2004 | Koga | |
| 6,769,766 | B2 * | 8/2004 | Suzuki et al. | 347/100 |
| 6,883,905 | B2 * | 4/2005 | Kimura et al. | 347/85 |
| 2004/0041892 | A1 * | 3/2004 | Yoneyama et al. | 347/102 |
| 2004/0135829 | A1 * | 7/2004 | Yoshida | 347/7 |

FOREIGN PATENT DOCUMENTS

| | | |
|---|---|---|
| JP | 7047687 | 2/2001 |
| JP | 2003175588 | 6/2003 |

* cited by examiner

*Primary Examiner* — Ellen Kim
(74) *Attorney, Agent, or Firm* — Frommer Lawrence & Haug LLP

(57) ABSTRACT

An inkjet printer including (1) a printhead for ejecting ink onto a sheet, (2) a plurality of main tanks, each holding ink and having a height dimension that is relatively small compared with its other dimensions, (3) a plurality of sub-tanks which supply ink to the printhead, and are configured to connect to the plurality of main tanks respectively so that ink can be supplied from the main tanks to the sub-tanks and (4) a mounting member into which the main tanks are detachably mounted, the main tanks being stacked on each other in a vertical direction when the main tanks are mounted in the mounting member. Wherein the main tanks are stacked on each other such that their height dimensions are arranged to substantially coincide with the vertical direction.

10 Claims, 6 Drawing Sheets

UP
DOWN
SHEET CONVEYING DIRECTION
100
110
111
120
121
122
122A
122B
122D
130
140
150
151
153
153A
154
155
160
161
162
163
164
165
166
170
180
181
182
183

INKJET PRINTER

This application claims priority from Japanese Patent Application No. 2006-267574 filed on Sep. 29, 2006, the entire subject matter of which is incorporated herein by reference.

BACKGROUND OF THE INVENTION

1. Field of the Invention

The invention relates to an inkjet printer that has a station type ink supply system in which a main tank and a sub-tank are capable of being connected to, and disconnected from, each other. The main tank and the sub-tank are connected to each other when ink is supplied from the main tank to the sub-tank.

2. Description of Related Art

In an inkjet printer, a printhead (ejecting head) ejects a droplet of ink onto a sheet of recording media to form an image. Japanese Laid-Open Patent Publication No. 2003-175588 discloses an inkjet printer in which a main tank and a printhead are constantly connected to each other using a tube such that ink is supplied from the main tank to the printhead.

In a printhead of an inkjet printer, a droplet of liquid, such as ink is ejected from a nozzle by a piezoelectric element when the piezoelectric element deforms. The droplet of ink may also be ejected from the nozzle by a heat-generating resister when that heat generating element volumetrically changes an air bubble. Usually, the nozzle is not provided with a valve. Rather, a meniscus is formed in the nozzle in a concave manner inwardly from the nozzle surface so that no ink leaks from the nozzle when the printhead is in stand-by mode.

The nozzle is a small opening. Accordingly, liquid in the nozzle forms a dome-shaped meniscus therein due to surface tension. The meniscus is concave when the pressure inside the nozzle is less than the atmospheric pressure. Such a meniscus prevents the liquid from leaking from the nozzle when the printhead is in stand-by mode.

In an inkjet printer in which the main tank and the printhead are constantly connected to each other, the ink level in the main tank is disposed so as to always be lower than a nozzle surface of the printhead. As a result, the pressure inside the nozzle is maintained at less than the atmospheric pressure.

A color inkjet printer, which forms a multicolor image by overlapping inks of basic colors, includes a plurality of main tanks corresponding to basic ink colors.

Each main tank of the color inkjet printer has a relatively small width compared to the other dimensions of the main tank. The main tanks are arranged in a horizontal direction such that the width of each main tank extends in the horizontal direction so that the height difference between each main tank and the printhead is the same.

In order to improve image quality, it is necessary to increase the number of basic ink colors. However, increasing the number of basic ink colors increases the number of main ink tanks. If the number of main tanks is increased in the inkjet printer, the dimension in the horizontal direction of a mounting space for the main tanks is increased.

In the case where ink meniscuses are maintained by the height difference between the ink level in the main tank and the printhead, the main tank needs to be mounted at a position low enough with respect to the printhead to ensure a sufficient height difference even when the main tank holds therein a large amount of ink or when the ink level in the main tank is high.

Inkjet printers have been downsized to meet the recent demands from the market. If a main tank is mounted at a position low enough with respect to a printhead of a compact inkjet printer, the main tank becomes positioned close to a mounting surface for the inkjet printer. In this case, when the user inserts or removes the main tank, the mounting surface might interfere with the user's hand.

In view of the forgoing problem, it is an object of the invention to provide a compact inkjet printer that allows easy access to main tanks, without increasing a dimension in a horizontal direction of a mounting space for the main tanks.

SUMMARY OF THE INVENTION

An inkjet printer including (1) a printhead for ejecting ink onto a sheet, (2) a plurality of main tanks, each holding ink and having a height dimension that is relatively small compared with its other dimensions, (3) a plurality of sub-tanks which supply ink to the printhead, and are configured to connect to the plurality of main tanks respectively so that ink can be supplied from the main tanks to the sub-tanks and (4) a mounting member into which the main tanks are detachably mounted, the main tanks being stacked on each other in a vertical direction when the main tanks are mounted in the mounting member. Wherein the main tanks are stacked on each other such that their height dimensions are arranged to substantially coincide with the vertical direction.

An inkjet printer including (1) a printhead for ejecting ink onto a sheet, (2) a plurality of main tanks, each holding ink, and (3) a mounting member into which the main tanks are detachably mounted, the main tanks being stacked on each other in a vertical direction when the main tanks are mounted in the mounting member.

DETAILED DESCRIPTION OF EMBODIMENTS

Figure 1:
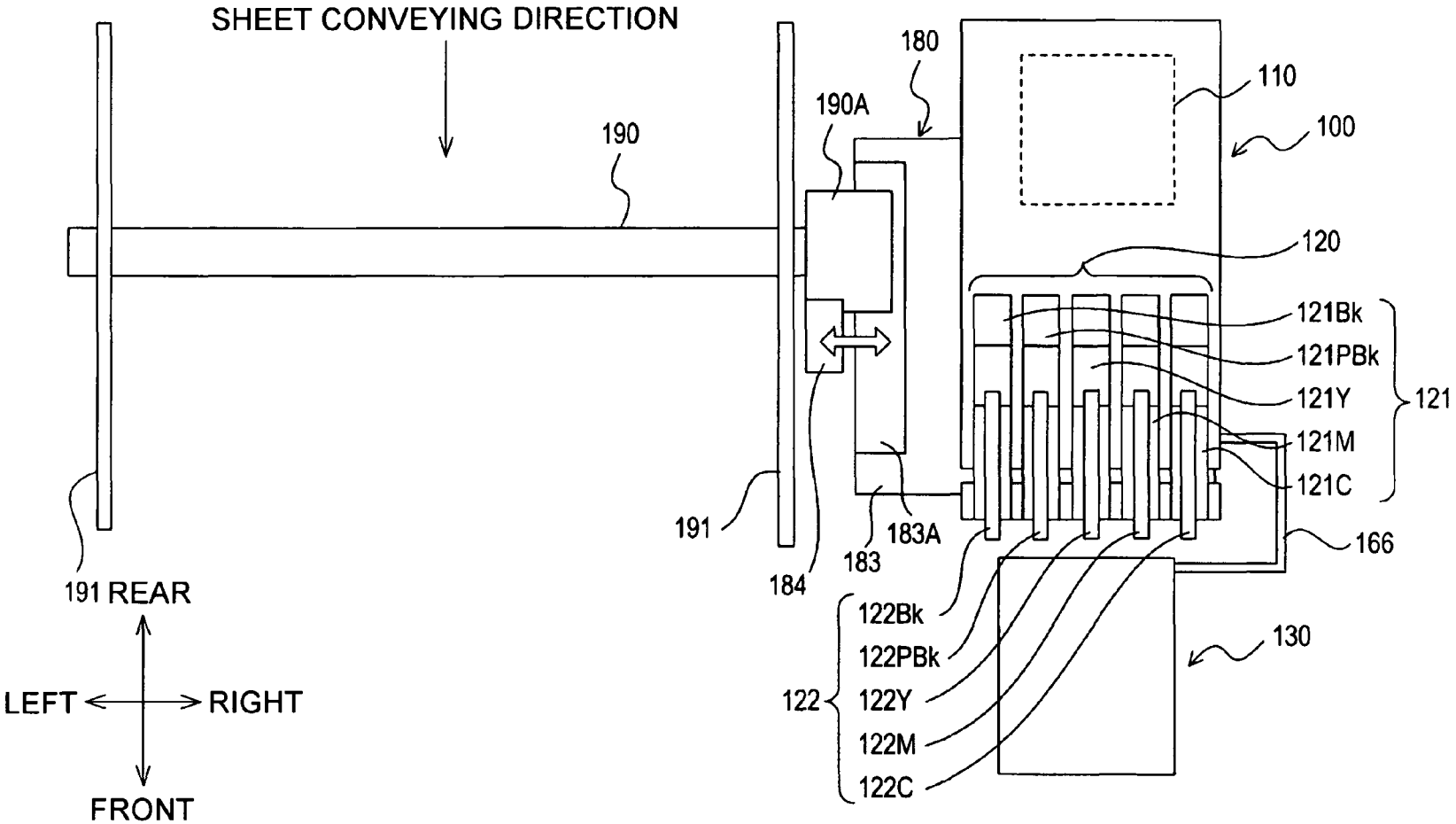
FIG. 1 is a schematic diagram of an image forming section of an inkjet printer as viewed from the above, according to an embodiment of the invention.
Figure 2:
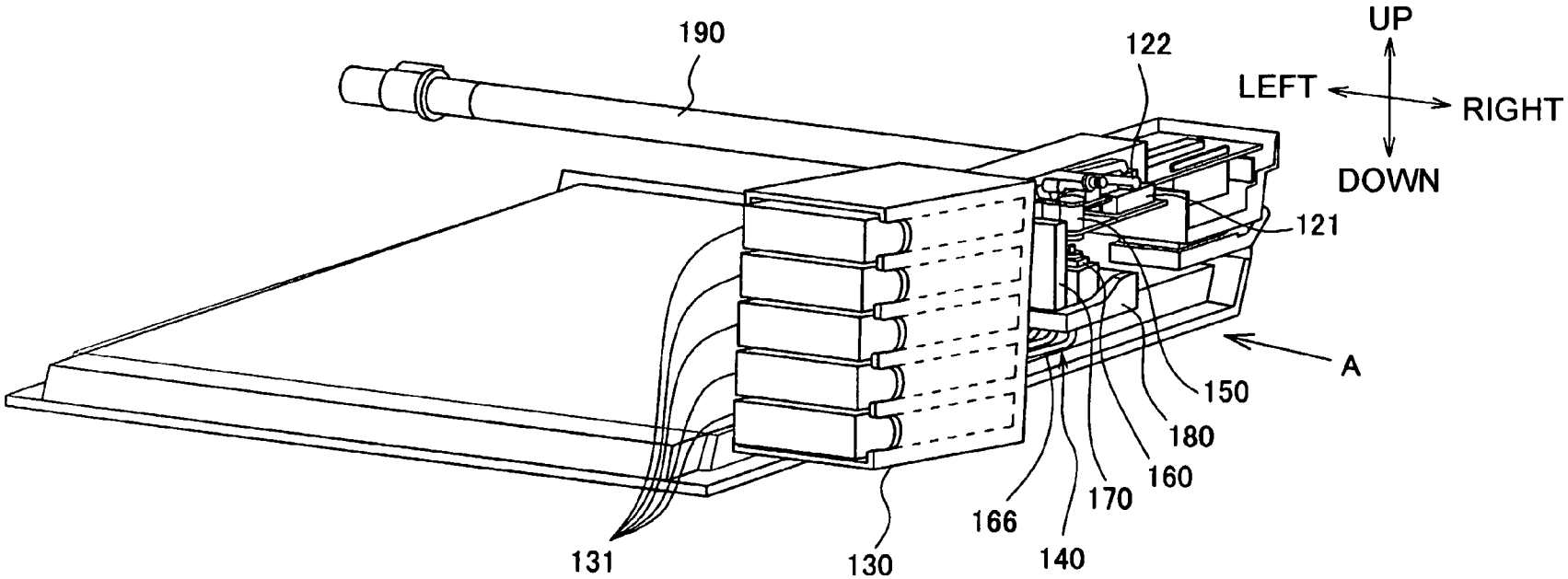
FIG. 2 is a perspective view of the image forming section.

Referring now to the drawings, the present invention will be described in detail on the basis of a first embodiment.

An inkjet printer forms an image on a sheet of recording media by ejecting ink droplets onto the sheet. The inkjet printer forms a multi-color image by overlapping inks of colors including cyan, magenta, yellow, and black.

In addition, black ink (pigment ink) is provided separately from photo black ink, and is used for monochromatic printing. Thus, the basic colors in this embodiment include cyan, magenta, yellow, photo black, and black for monochromatic printing.

In a station type ink supply system, a main tank unit 130 and a sub-tank 121 are connected to each other to enable ink to be supplied from the main tank unit 130 to the sub-tank 121. The main tank unit 130 and the sub-tank 121 are disconnected from each other when the main tank unit 130 is not supplying the sub-tank unit 121 with ink. In this way, the station type ink supply system enables an ink supply path between a sub-tank 121 and a main tank 130 to be connectable/disconnectable.

In this embodiment, when the amount of ink remaining in the sub-tank 121 becomes less than a predetermined amount, ink is supplied from the main tank unit 130 to the sub-tank 121 while they are connected to each other. When the amount of ink remaining in the sub-tank 121 is greater than the predetermined amount, the main tank unit 130 and the sub-tank 121 are kept disconnected from each other.

A printhead unit (carriage) 100 includes a printhead 110 that ejects ink droplets onto the sheet, and a sub-tank unit 120 that supplies ink to the printhead 110. When forming an image, the printhead unit 100 reciprocates in a main scanning direction (right-left direction in FIG. 1) that is perpendicular to a sheet conveying direction.

Nozzles for ejecting basic color inks are formed in a nozzle surface 111 (see FIG. 4A) of the printhead 110 that faces the sheet to be conveyed. The nozzles are arranged in arrays parallel to the sheet conveying direction. Each nozzle array corresponds to one of the basic color inks.

The sub-tank unit 120 includes sub-tanks 121C (cyan), 121M (magenta), 121Y (yellow), 121PBk (photo black), and 121Bk (black for monochromatic printing) arranged side by side in the main scanning direction. The sub-tank unit 120 also includes levers 122C, 122M, 122Y, 122PBk, 122Bk, each pushing a corresponding one of the sub-tanks 121C, 121M, 121Y, 121PBk, 121Bk.

The sub-tanks 121C, 121M, 121Y, 121PBk, 121Bk are collectively called sub-tank(s) 121, because they are the same except for the color of the ink to be stored therein. Also, the levers 122C, 122M, 122Y, 122PBk, 122Bk are collectively called lever(s) 122 because they are the same except that they push different sub-tanks 121.

Figures 4A, 4B:
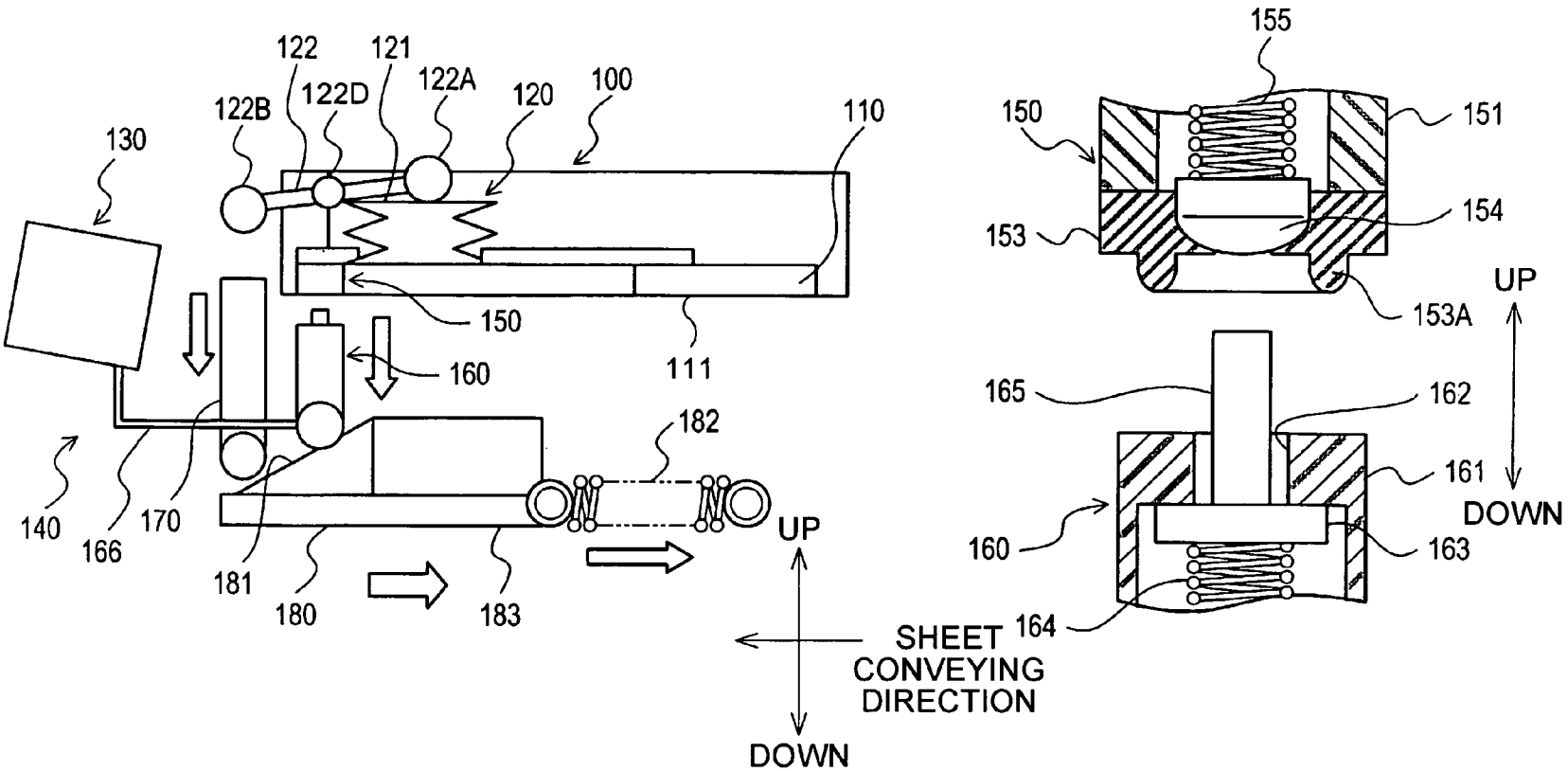
FIG. 4A is an illustrative diagram showing an ink supply operation.
FIG. 4B is an illustrative diagram showing joint valves operated during ink supply operation.

The sub-tank 121 is configured to deform (expand and contract) elastically in a direction perpendicular to both the main scanning direction and the sheet conveying direction. To be specific, the sub-tank 121 has a form of bellows, as shown in FIG. 4A. In this embodiment, the sub-tank 121 has a rectangular cross-section that is perpendicular to the expanding and contracting directions of the sub-tank 121.

Figure 3:
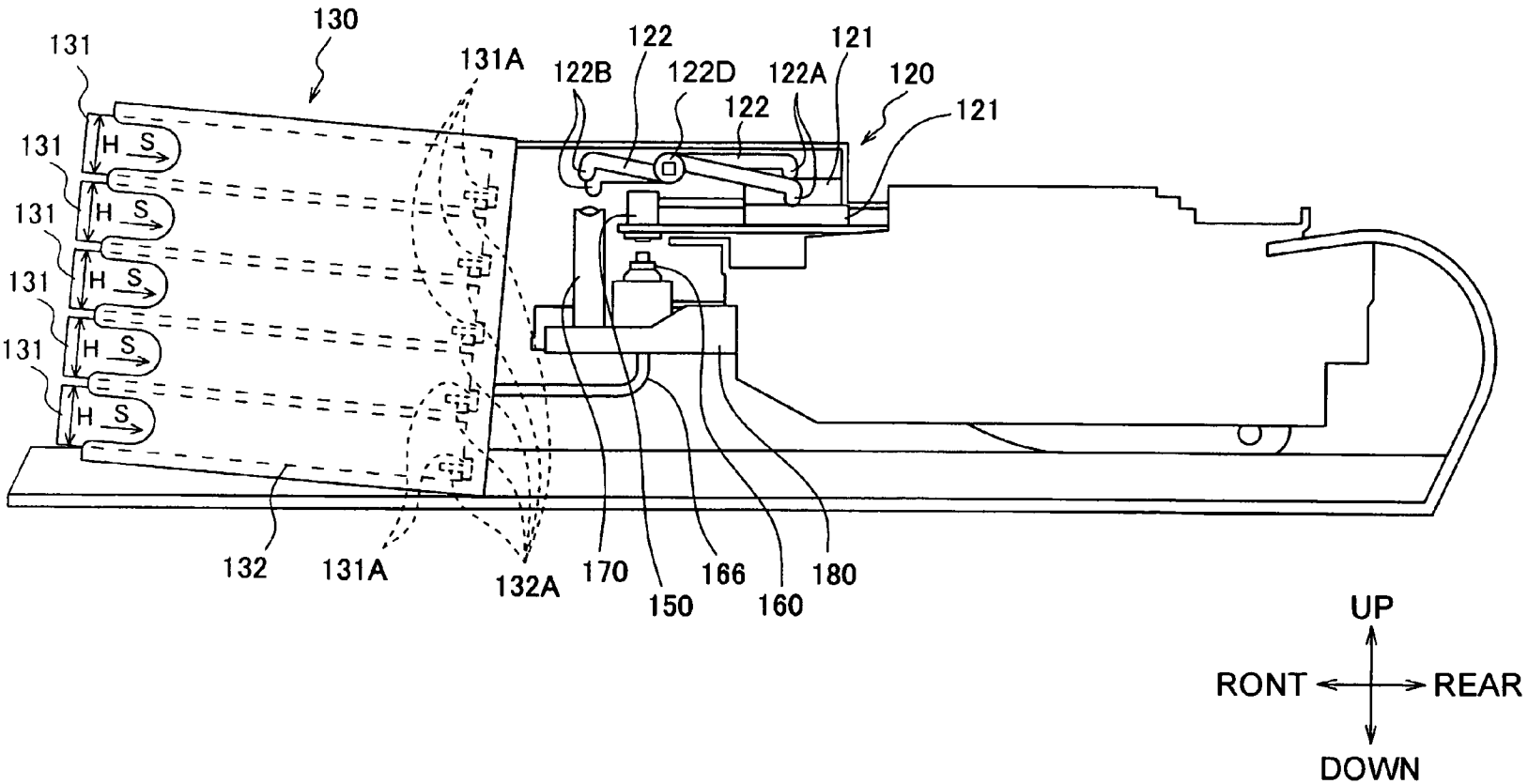
FIG. 3 is a view as viewed in a direction of arrow A of FIG. 2.

As shown in FIG. 3, the lever 122, as a pushing member, is connected, at its one end 122A, to an upper end of each sub-tank 121 and extends, at its other end 122B beyond an outer edge of the printhead unit 100. The lever 122 is rotatably supported by a support 122D that is fixed to a main body of the printhead unit 100.

As shown in FIG. 3, the main tank unit 130 includes ink cartridges 131, as main tanks, filled with ink to be supplied to the corresponding sub-tanks 121. The main tank unit 130 also includes a cartridge casing 132 to which the ink cartridges 131 are detachably mounted.

Each ink cartridge 131 has a flat box shape with a relatively small height H as compared to its other dimensions. The ink cartridges 131 are mounted in the cartridge casing 132 while the ink cartridges are stacked on each other in their height directions such that their height direction substantially coincides with a vertical direction (up/down direction of FIG. 3). In this embodiment, the monochromatic black, photo black, yellow, magenta, and cyan ink cartridges 131 are arranged from the top, in this order.

Figure 5B:
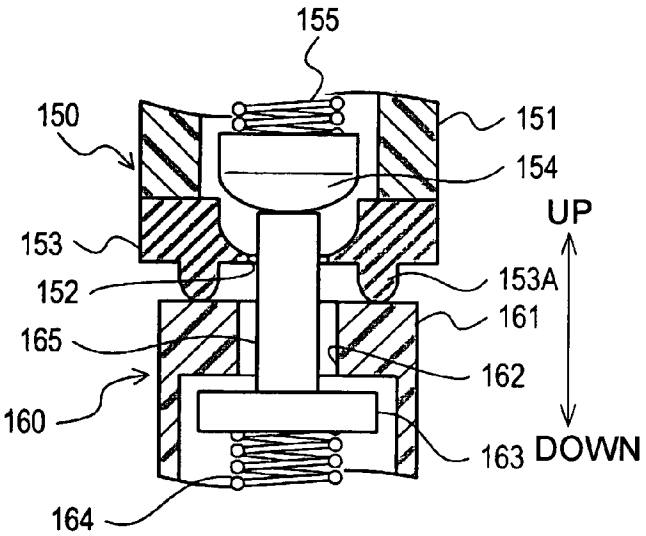
FIG. 5B is an illustrative diagram showing joint valves operated during ink supply operation.
Figure 5A:
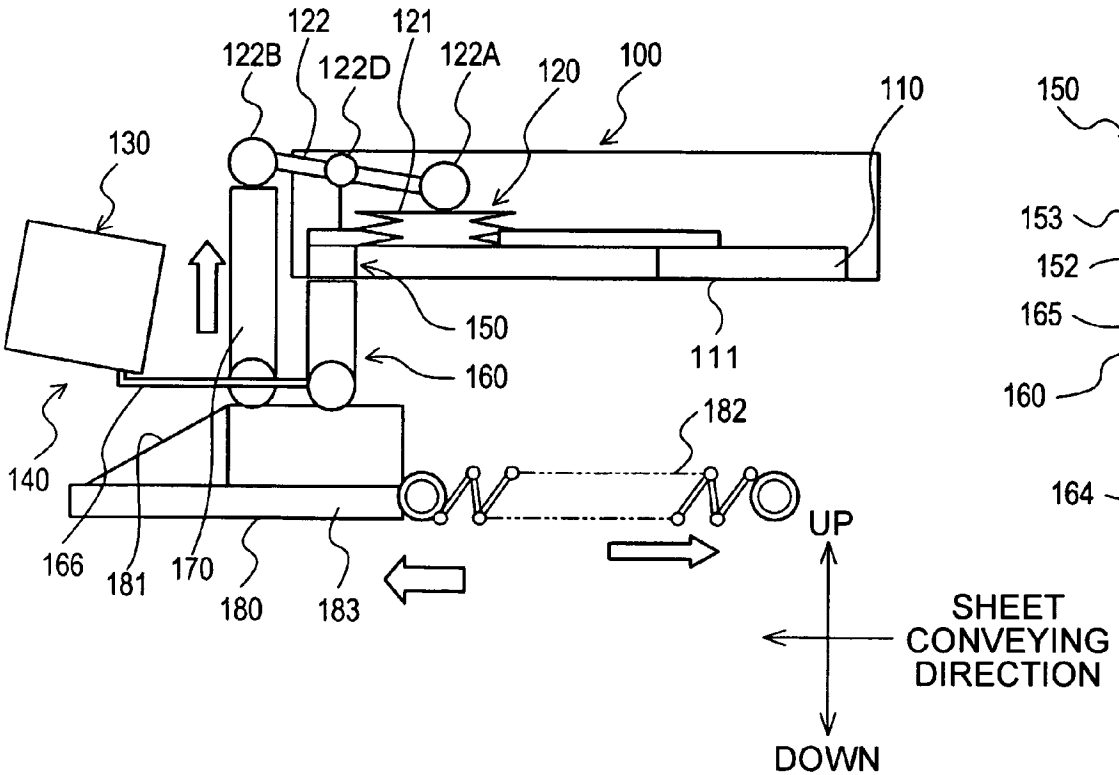
FIG. 5A is an illustrative diagram showing an ink supply operation.
Figure 6:
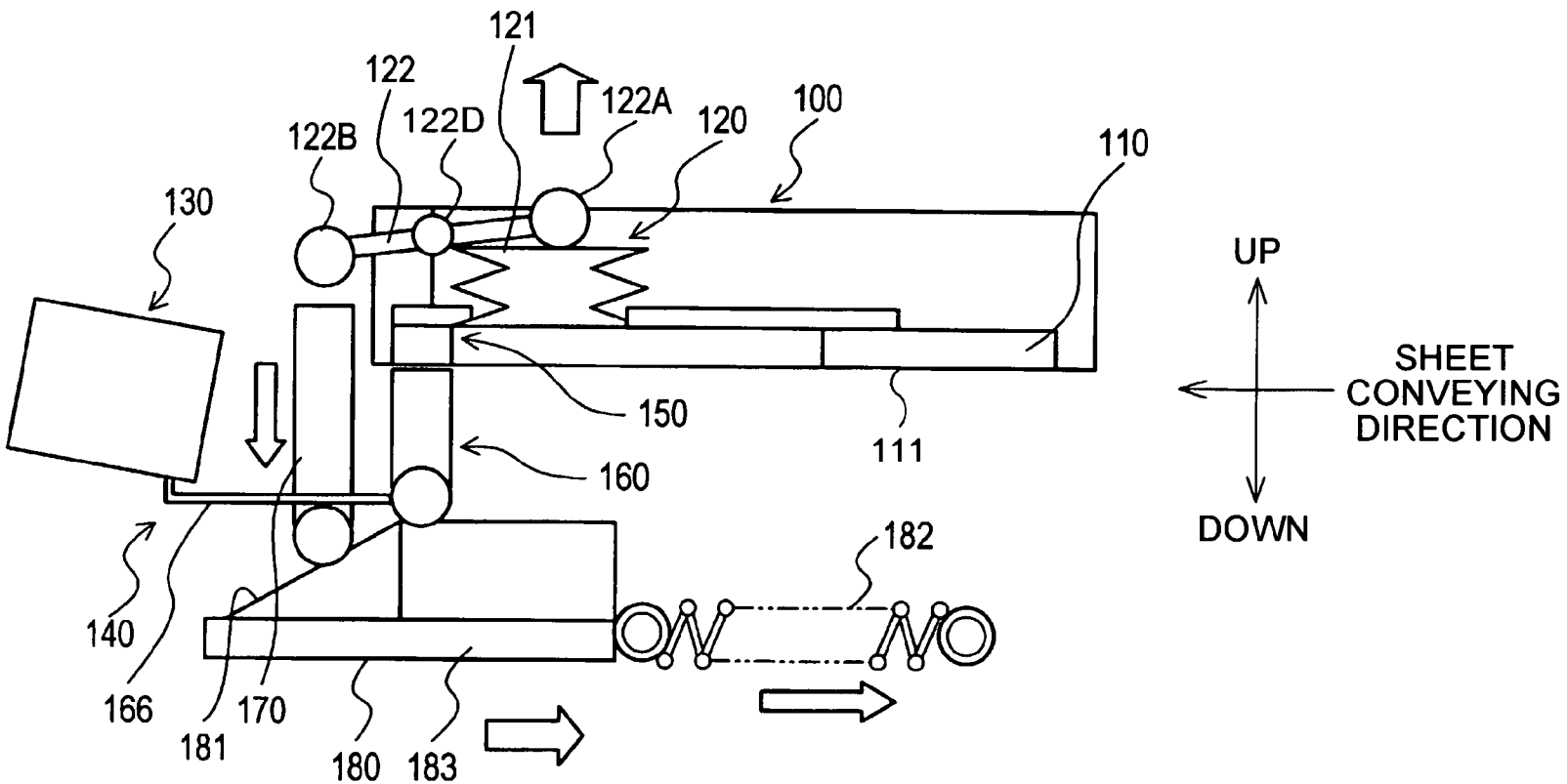
FIG. 6 is an illustrative diagram showing an ink supply operation.

As shown in FIGS. 4A, 5A, and 6, at least one of the ink cartridges 131 is disposed at a position in the vertical direction higher than a nozzle surface 111 of the printhead 110 when that one ink cartridge 131 is mounted into the cartridge casing 132.

The nozzle surface 111 of the printhead 110 is positioned in the vertical direction to be between the highest portion of the uppermost ink cartridge 131 and the lowest portion of the lowermost ink cartridge 131 when all of the ink cartridges 131 are mounted into the cartridge casing 132. In this way, the inkjet printer can be compact in height as well as in width.

An ink supply port 131A, for supplying ink from an ink cartridge 131 to the corresponding sub-tank 121, is provided at a forward end face of each ink cartridge 131 with respect to its mounting direction (a direction of arrow S in, and the rear direction of, FIG. 3). Each ink cartridge 131 is mounted in the cartridge casing 132 at an angle with respect to the horizontal direction (front/rear direction of FIG. 3) such that the ink supply port 131A is located at the lowest position of each ink cartridge 131.

As apparent from FIG. 3, a state where the height direction of the ink cartridge 131 substantially coincides with the vertical direction (up/down direction of FIG. 3) includes a state where the ink supply port 131A is located at the lowest position of the ink cartridge 131. More specifically, the height direction of the ink cartridge 131 is angled with respect to the vertical direction at an angle ranging from 0 degrees to approximately 30 degrees. Angles of greater than approximately 30 degrees increase the height of the inkjet printer too much. This makes it more difficult to mount and remove the ink cartridge 131.

A valve (not shown) is provided in each ink cartridge 131 to open and close the ink supply port 131A. A needle 132A is provided in the cartridge casing 132 at a position facing the ink supply port 131A to push the valve inward of the ink cartridge 131.

When the ink cartridge 131 is mounted in the cartridge casing 132, the needle 132A pushes the valve inward of the ink cartridge 131, thereby opening the ink supply port 131A. On the other hand, when the ink cartridge 131 is removed from the cartridge casing 132, the valve is shifted outward of the ink cartridge 131, thereby closing the ink supply port 131A.

Construction of a station type ink supply mechanism will now be described. As shown in FIG. 4A, a station type ink supply mechanism (hereinafter referred to as an ink supply mechanism) 140 includes a sub-tank joint valve 150, a main tank joint valve 160, a push rod 170 that pushes the end 122B of the lever 122, and a slide cam 180 that actuates the main tank joint valve 160 and the push rod 170.

The sub-tank joint valve 150, the main tank joint valve 160, and the push rod 170 are provided for each of the sub-tanks 121, and the structures of these members are the same among the sub-tanks 121. The slide cam 180 is provided commonly for the sub-tanks 121, and the slide cam 180 is integral with a base plate 183. Accordingly, all of the sub-tanks 121 are replenished with ink simultaneously. This is the case even if one or more of the sub-tanks 121 do not need to be replenished with ink. The process for replenishing the ink tanks will be described in detail below.

The sub-tank joint valve 150, as a connecting valve, is fixed to the main body of the printhead unit 100 and communicates with the sub-tank 121. As shown in FIG. 4B, a valve cap 153 having a valve opening 152 (FIG. 5B) is sealingly assembled at an end of a cylindrical valve housing 151 near the main tank joint valve 160. The valve opening 152 is closed by a valve member 154 that is shiftable inward of the valve housing 151.

In this embodiment, the valve cap 153 is made of an elastic material, such as an elastomer, and has an annular projection 153A that surrounds the valve opening 152 and projects toward the main tank joint valve 160.

A coil spring 155, as an elastic member, pushes the valve member 154 from inside the sub-tank joint valve 150 toward the outside of the sub-tank joint valve 150, so as to close the valve opening 152. The initial load and the spring constant of the coil spring 155 are set such that the total (F1+F2) of a pushing force F1 exerted by a pressure inside the valve housing 151 to close the valve member 154, and a pushing force F2 exerted by the coil spring 155 on the valve member 154, is equal to or slightly greater than a pushing force F3 exerted by the atmospheric pressure to open the valve member 154.

The sub-tank joint valve 150 communicates with the sub-tank 121 at an upper side of the sub-tank 121, and the sub-tank 121 communicates with the printhead 110 at a lower side of the sub-tank 121.

To supply ink from the ink cartridge 131 to the sub-tank 121, the main tank joint valve 160 is connected to the sub-tank joint valve 150, such that the sub-tank 121 communicates with the ink cartridge 131. As shown in FIG. 4A, the main tank joint valve 160 communicates with the ink cartridge 131 via an ink supply conduit such as a pipe or a tube 166.

As shown in FIG. 4B, a valve opening 162 is provided at an end near the valve cap 153 of a cylindrical valve housing 161. The valve opening 162 is closed by a valve member 163 that is shiftable inward of the valve housing 161.

A coil spring 164, as an elastic member, exerts a pushing force on the valve member 163 to close the valve opening 162. A push rod 165 projects toward the sub-tank joint valve 150 to push the valve member 154 of the sub-tank joint valve 150, so as to open the valve opening 152. The push rod 165 is integral with the valve member 163 and is shifted integrally with the valve member 163.

The slide cam 180 has a cam surface 181 that makes contact with longitudinal lower ends of the push rod 170 and the ink tank joint valve 160 (valve housing 161) to move the push rod 170 and the joint valve 160 in their longitudinal directions (vertically in this embodiment).

In this embodiment, in order to move the push rod 170 and the main tank joint valve 160 upward, the slide cam 180 is moved leftward in FIG. 4A by a driving force from a discharge roller 190 (see FIG. 1).

In order to move the push rod 170 and the main tank joint valve 160 downward, the driving force from the discharge roller 190 is disconnected and the slide cam 180 is moved rightward in FIG. 4A by an elastic force of a spring 182.

The slide cam 180, which is provided commonly for the sub-tanks 121, is integral with a base plate 183. As shown in FIG. 1, the base plate 183 is provided, on its side near the discharge roller 190, with a rack gear 183A.

A pinion gear 184 that transmits the driving force from a gear 190A, disposed at an longitudinal end of the discharge roller 190, to a rack gear 183A, disposed on the base plate 183, is disposed movably between a position where the pinion gear 184 meshes with the rack gear 183A and a position where the pinion gear 184 is released from the rack gear 183A. The positions of the pinion gear 184 are changed by an actuator. One example of such an actuator is an electromagnetic solenoid.

The discharge roller 190 conveys a sheet, with an image printed thereon, to a discharge port (not shown). The sheet is conveyed between a pair of frames 191 to the discharge port.

Operation of the ink supply mechanism 140 will now be described. The ink supply mechanism 140, as a station type ink supply mechanism, connects the main tank joint valve 160 to the sub-tank joint valve 150, so as to supply ink from the ink cartridge 131 to the sub-tank 121 when the amount of ink remaining in the sub-tank 121 becomes less than a predetermined amount.

In this embodiment, the time at which the amount of oil remaining in the sub-tank 121 becomes less than the predetermined amount is determined based on the number of ink ejections that are performed by the printhead 10 for both printing and purging. The ink ejections are counted starting from the last time that ink was supplied to the sub-tank 121. When the number of ink ejections reaches a predetermined number, the amount of remaining ink is estimated to be less than the predetermined amount.

When a controller (not shown) that controls operation of the inkjet printer determines that the amount of ink remaining in the sub-tank 121 is less than the predetermined amount, the controller moves the pinion gear 184 to the position to mesh with the rack gear 183A and rotates the discharge roller 190.

Consequently, the slide cam 180 is moved leftward in FIG. 5A, thereby moving the push rod 170 and the main tank joint valve 160 upward.

As shown in FIG. 5B, the main tank joint valve 160 raises up the valve member 154 of the sub-tank joint valve 150, thereby opening the valve opening 152.

At the same time, the valve member 163 of the main tank joint valve 160 receives a pushing force to open the valve opening 162 via the push rod 165. The valve member 163 is shifted downward to open the valve opening 162, thereby bringing the sub-tank 121 in communication with the ink cartridge 131.

The upper end of the push rod 170 pushes up the other end 122B of the lever 122. As shown in FIG. 5A, the end 122A of the lever 122 moves downward to compress and deform the sub-tank 121. At this time, ink remaining in the sub-tank 121 returns to the ink cartridge 131 and is not wasted.

In this embodiment, the shape of the cam surface 181 and the moving direction of the slide cam 180 are set such that compression of the sub-tank 121 is started after the sub-tank joint valve 150 has been connected to the main tank joint valve 160. If the sub-tank 121 is compressed before the connection between the joint valves 150 and 160, ink might leak from the connecting portions of the joint valves 150 and 160.

Also, the shape of the cam surface 181, and the moving speed of the slide cam 180, are set such that the sub-tank 121 is compressed with a pressure that will not break a meniscus formed in each ejection port of the printhead 110 (e.g. 4 kPa or smaller). If the sub-tank 121 is compressed with an excessively great pressure, the meniscus might be broken.

When a predetermined time has elapsed after the discharge roller 190 is rotated while the pinion gear 184 meshes with the rack gear 183A, or when the total rotation amount of the discharge roller 190 reaches a predetermined amount, the controller determines that the compression of the sub-tank is completed. The controller then moves the pinion gear 184 to the position to be released from the rack gear 183A and stops the discharge roller 190.

Consequently, as shown in FIG. 5, the slide cam 180 starts moving rightward, the push rod 170 is shifted downward, and the sub-tank 121 expands to return to its original shape. At this time, ink in the ink cartridge 131 is drawn and supplied to the sub-tank 121.

When the slide cam 180 moves further rightward in FIG. 6, the push rod 170 is shifted away from the lever 122, and the joint valves 150 and 160 disconnect from each other and close.

In this embodiment, the shape of the cam surface 181 and the moving direction of the slide cam 180 are set such that the connection between the joint valves 150 and 160 is released after the push rod 170 has been separated from the lever 122. If the connection between the joint valves 150 and 160 are released while the push rod 170 is in contact with the lever 122, ink might leak from the connecting portions of the joint valves 150 and 160.

As shown in FIG. 4, during image forming, the joint valves 150 and 160 are kept disconnected from each other and closed. As ink in the sub-tank 121 is consumed, the sub-tank 121 elastically deforms to contract. The pressure inside the sub-tank 121 lowers and the lowered pressure, which is less than the atmospheric pressure, maintains the meniscuses formed in the nozzles of the printhead 110.

At this time, if the pressure inside the sub-tank 121 lowers excessively upon a consumption of a large amount of ink in the sub-tank 121, the pressure difference between the atmospheric pressure and the pressure inside the sub-tank 121 becomes excessively great, causing a breakage of the meniscuses.

In this embodiment, however, the initial load and the spring constant of the coil spring 155 are set such that the total (F1+F2) of a pushing force F1 exerted by a pressure inside the valve housing 151 to close the valve member 154, and a pushing force F2 exerted by the coil spring 155 on the valve member 154, is equal to or slightly greater than a pushing force F3 exerted by the atmospheric pressure to open the valve member 154. Accordingly, if the pressure inside the sub-tank 121 lowers excessively, the sub-tank joint valve 150 is opened to increase the pressure inside the sub-tank 121. Then, when the pressure difference between the atmospheric pressure and the pressure inside the sub-tank 121 decreases such that the pressure difference is equivalent to or slightly less than the pushing force of the coil spring 155, the sub-tank joint valve 150 closes. Accordingly, the pressure inside the sub-tank 121 is maintained at a pressure appropriate to maintain the meniscuses.

In short, the sub-tank joint valve 150 is automatically controlled to be opened or closed mechanically such that the pressure difference between the atmospheric pressure and the pressure inside the sub-tank 121 is maintained at a pressure difference equivalent to the pushing force of the coil spring 155.

In an inkjet printer adopting a station-type ink supply mechanism, such as the station-type ink supply mechanism of the present embodiment, the ink cartridges 131 and the sub-tanks 121 are disconnected from each other when no ink is being supplied from the ink cartridges 131 to the sub-tanks 121, including during the image forming process. Thus, the meniscuses formed in the nozzles of the printhead 110 can be maintained regardless of the height difference between the ink level in the ink cartridges 131 and the nozzle surface 111 of the printhead 110. Thus, the ink cartridges 131 can be stacked on top of each other without disrupting the meniscuses. Accordingly, the number of ink cartridges 131 can be increased without increasing the horizontal dimension of the mounting space for the ink cartridges 131.

In addition, the ink cartridges 131 can be spaced at a desirable distance from the surface on which the inkjet printer is mounted so as to facilitate mounting of the main tanks to, and removal of the main tanks from, the inkjet printer.

In the inkjet printer according to the above-described embodiment, the main tanks can be accessed easily without increasing the mounting space for the main tanks in the horizontal direction.

In the inkjet printer as described above, each ink cartridge 131 is mounted in the cartridge casing 132 at an angle with respect to the horizontal direction (front/rear direction of FIG. 3) such that the ink supply port 131A is located at the lowest position of each ink cartridge 131. This prevents a large amount of ink from remaining in the cartridge without being consumed.

In the inkjet printer as described above, the monochromatic black ink cartridge 131 is disposed at the highest position among the ink cartridges 131. This reliably prevents the mounting surface for the inkjet printer from interfering with the user's hand when the user mounts or removes the monochromatic black ink cartridge 131. Accordingly, the user can easily mount or remove the monochromatic black ink cartridge 131, which requires frequent replacement because monochromatic black ink is consumed in a relatively greater amount than any of the other color inks.

Although the ink cartridges 131 in the above-described embodiment are mounted in the cartridge casing 132 at an angle with respect to the horizontal direction such that the ink supply port 131A is located at the lowest position of each ink cartridge 131, the invention is not limited to this embodiment. For example, the ink cartridges 131 may be arranged along the horizontal direction.

Although, in the above-described embodiment, the monochromatic black ink cartridge 131 is disposed at the highest position among the ink cartridge 131, the invention is not limited to this embodiment. For example, the monochromatic black ink cartridge 131 may be disposed at the lowest position among the ink cartridges 131.

Although, in the above-described embodiment, the sub-tank joint valve 150 is controlled to open and close according to the pressure inside the sub-tank 121 so as to maintain the meniscuses in the nozzles, the invention is not limited to this embodiment. For example, the meniscuses of the nozzles may be maintained using the capillary force of a porous member such as a foam or sponge.

Although, in the above-described embodiment, the sub-tank 121 has a form of bellows, the invention is not limited to this embodiment. For example, the sub-tank 121 may alternatively be a tank configured to be unchanged in volume, or a tank configured to be changed in volume and having a cylinder and a piston.

Although, in the above-described embodiment, the amount of ink remaining in the sub-tank 121 is estimated based on the number of ink ejections, the invention is not limited to this embodiment. For example, the amount of ink remaining in the tank 121 may be estimated based on changes in the electrical resistance in the sub-tank 121.

Although, in the above-described embodiment, the sub-tank joint valve 150 communicates with the sub-tank 121 at the upper side of the sub-tank 121 while the sub-tank 121 communicates with the print head 110 at the lower side of the sub-tank 121, the invention is not limited to this embodiment. For example, the sub-tank joint valve 150 may communicate with the sub-tank 1 at the lower side of the sub-tank 121 while the sub-tank 121 may communicate with the print head 110 at the upper side of the sub-tank 121.

Although, in the above-described embodiment, the main tank joint valve 160 and the push rod 170 are shifted by the slide cam 180, the invention is not limited to this embodiment. For example, the main tank joint valve 160 and the push rod 170 may be shifted by an electrical actuator such as an electromagnetic solenoid.

Although, in the above-described embodiment, the valve member 163 makes direct contact with the periphery of the valve opening 162, an alternative configuration may be provided wherein an O-ring is disposed at contact portions between the valve member 163 and the periphery of the valve opening 162.

The inkjet printer according to the above-described embodiment may be used, for example, by being connected to a personal computer. In another example, the inkjet printer according to the above-described embodiment may be adopted as a printing section in a facsimile machine.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

What is claimed is:

1. An inkjet printer comprising:

a carriage configured to reciprocate in a horizontal direction;

a printhead disposed on the carriage and configured to eject ink from a plurality of nozzle arrays thereof onto a sheet while reciprocating together with the carriage;

a plurality of main tanks, each holding ink and having a height dimension that is relatively small compared with its other dimensions;

a plurality of sub-tanks disposed on the carriage and configured to reciprocate together with the carriage and to supply ink to the printhead a plurality of joint units configured to selectively fluidly communicate the main tanks with the sub-tanks respectively; and a mounting member into which the main tanks are detachably mounted, the main tanks being stacked on each other in a vertical direction when the main tanks are mounted in the mounting member;

wherein the main tanks are stacked on each other such that their height dimensions are arranged to substantially coincide with the vertical direction.

2. The inkjet printer according to claim 1;

wherein each of the main tanks has an ink supply port through which ink is supplied to one of the plurality of the sub-tanks, and wherein each ink supply port is located at the lowest position, in the vertical direction, of its respective main tank when that respective main tank is mounted in the mounting member.

3. The inkjet printer according to claim 2;

wherein each of the main tanks is shaped like a box;

wherein each ink supply port is located at an end face of its respective main tank, the end face being a forward end of that respective main tank with respect to a mounting direction; and wherein the mounting direction is the direction in which that respective main tank is mounted into the mounting member.

4. The inkjet printer according to claim 1;

wherein the plurality of main tanks include a main tank that holds black ink; and wherein the main tank that holds black ink is located at the top of the main tanks when the main tanks are mounted into the mounting member.

5. The inkjet printer according to claim 1;

wherein the height dimensions of the main tanks are inclined with respect to the vertical direction.

6. The inkjet printer according to claim 1;

wherein at least one of the plurality of main tanks is disposed at a position in the vertical direction higher than a nozzle surface of the printhead when that one main tank is mounted into the mounting member.

7. The inkjet printer according to claim 1;

wherein a nozzle surface of the printhead is positioned in the vertical direction to be between the highest portion of the uppermost main tank and the lowest portion of the lowermost main tank when all of the main tanks are mounted into the mounting member.

8. The inkjet printer according to claim 1;

wherein the joint units include a plurality of first joint members disposed in the carriage and fluidly communicating with the sub-tanks respectively, and a plurality of second joint members disposed outside the carriage and fluidly communicating with the main tanks respectively; and wherein ink is supplied from the main tanks to the sub-tanks respectively when the first joint members are engaged with the second joint members respectively, and the printhead and the sub-tanks reciprocate together with the carriage when the first joint members are separated from the second joint members respectively.

9. The inkjet printer according to claim 1;

wherein the sub-tanks have a form of bellows configured to contract and expand to draw ink from the main-tanks respectively when the joint units fluidly communicate the main tanks with the sub-tanks respectively.

10. The inkjet printer according to claim 9;

wherein the joint units further include a plurality of pushing members configured to push down the sub-tanks respectively when the joint units fluidly communicate the main tanks with the sub-tanks respectively.

* * * * *